US007802874B2

(12) United States Patent
Wee et al.

(10) Patent No.: US 7,802,874 B2
(45) Date of Patent: Sep. 28, 2010

(54) RESTRICTORS WITH STRUCTURE TO PREVENT BACK FLOW AND INKJET HEAD HAVING THE SAME

(75) Inventors: Sang-kwon Wee, Hwaseong-si (KR); Se-young Oh, Yongin-si (KR); Jae-woo Chung, Yongin-si (KR); Mi-jeong Song, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 728 days.

(21) Appl. No.: 11/756,061

(22) Filed: May 31, 2007

(65) Prior Publication Data

US 2008/0129798 A1 Jun. 5, 2008

(30) Foreign Application Priority Data

Dec. 1, 2006 (KR) ..... 10-2006-0120958

(51) Int. Cl.
*B41J 2/45* (2006.01)

(52) U.S. Cl. ..... 347/68; 347/69; 347/70; 347/71; 347/72; 347/65

(58) Field of Classification Search ..... 347/62, 347/65, 67, 68–72
See application file for complete search history.

(56) References Cited

U.S. PATENT DOCUMENTS 4,823,149 A * 4/1989 Martner et al. ..... 347/71
6,416,172 B2 * 7/2002 Jeong et al. ..... 347/72
7,357,499 B2 * 4/2008 Kim ..... 347/92
7,607,760 B2 * 10/2009 Ito ..... 347/68
2003/0218659 A1 * 11/2003 Ito ..... 347/71

* cited by examiner

*Primary Examiner*—Charlie Peng
*Assistant Examiner*—Guy G Anderson
(74) *Attorney, Agent, or Firm*—Stanzione & Kim LLP

(57) ABSTRACT

A restrictor with a structure to prevent a back flow of ink and an inkjet head including the restrictor. In the inkjet head, an ink channel is formed in a channel plate, and the ink channel includes an ink inlet, a plurality of pressure chambers, a manifold, a plurality of restrictors respectively connecting the pressure chambers to the manifold, and a plurality of nozzles. Piezoelectric actuators are formed on the channel plate. Each of the restrictors includes a plurality of protrusions formed on an inner surface thereof in a structure suitable to increase a flow resistance of the restrictor when ink flows from the pressure chamber to the manifold through the restrictor. Each of the protrusions includes a first surface facing a flow of ink moving through the restrictor in a direction from the manifold to the pressure chamber, and a second surface facing a flow of ink moving through the restrictor in a direction from the pressure chamber to the manifold. The first surface has a low flow resistance, and the second surface has a high flow resistance. Therefore, a black flow of ink is restricted when ink is ejected, and sufficient ink can be supplied through the restrictor during an ink refill process.

23 Claims, 5 Drawing Sheets

RESTRICTORS WITH STRUCTURE TO PREVENT BACK FLOW AND INKJET HEAD HAVING THE SAME

CROSS-REFERENCE TO RELATED APPLICATIONS

This application claims the benefit of Korean Patent Application No. 10-2006-0120958, filed on Dec. 1, 2006, in the Korean Intellectual Property Office, the disclosure of which is incorporated herein in its entirety by reference.

BACKGROUND OF THE INVENTION

1. Field of the Invention

The present general inventive concept relates to a piezoelectric inkjet head, and more particularly, to a restrictor having a structure to prevent a back flow, and a piezoelectric inkjet head including the restrictor.

2. Description of the Related Art

Inkjet heads are devices used to form color images on printing mediums such as paper and fabric by firing droplets of ink onto a desired region of a corresponding printing medium. Inkjet heads can be classified into various types depending on the ink ejecting method to be used. For example, a thermal inkjet head generates ink bubbles by using heat and ejects the ink by utilizing the expansion of the bubbles, and a piezoelectric inkjet head ejects ink using a pressure generated by deforming a piezoelectric material.

FIGS. 1 and 2 illustrate a general structure of a conventional piezoelectric inkjet printhead.

Referring to FIGS. 1 and 2, an ink channel is formed in first to third channel plates 10, 20, and 30. The ink channel includes an ink inlet 61, a manifold 62, a plurality of restrictors 63, a plurality of pressure chambers 64, and a plurality of nozzles 65. Piezoelectric actuators 40 are formed on the first channel plate 10 respectively corresponding to the pressure chambers 64. The manifold 62 is formed in the second channel plate 20 to receive ink from an ink tank (not illustrated) through the ink inlet 61 and supply the ink to the respective pressure chambers 64. The restrictors 63 are formed in a top surface of the second channel plate 20 for respectively connecting the manifold 62 to the pressure chambers 64. The pressure chambers 64 store ink that is to be ejected. The pressure chambers 64 are formed in the second channel plate 20. The pressure chambers 64 are arranged at one side or both sides of the manifold 62. The pressure chambers 64 change in volume due to operation of the piezoelectric actuators 40, and as a result, the pressure in the pressure chambers 64 changes. Thus, ink can be ejected from or introduced into the pressure chambers 64 due to the pressure change. Portions of the first channel plate 10 covering the pressure chambers 64 are referred to as vibration plates 12. The vibration plates 12 deform by pressure applied from the piezoelectric actuators 40. The nozzles 65 are formed through the third channel plate 30 and are respectively connected to the pressure chambers 64.

The conventional piezoelectric inkjet head illustrated in FIGS. 1 and 2 operates as follows. When a driving signal is applied to the piezoelectric actuator 40, the piezoelectric actuator 40 deforms the vibration plate 12 to reduce the volume of the pressure chamber 64. As a result, the pressure in the pressure chamber 64 increases, and thus, ink is ejected to the outside of the pressure chamber 64 through the respective nozzle 65. Thereafter, when the piezoelectric actuator 40 and the vibration plate 12 both return to their original shapes, the volume of the pressure chamber 64 increases, and the pressure in the pressure chamber 64 decreases. Therefore, ink can be introduced into the pressure chamber 64 from the manifold 62 through the restrictor 63 to refill the pressure chamber 64.

However, in the conventional piezoelectric inkjet head, ink can flow back from the pressure chamber 64 to the manifold 62 through the restrictor 63 when the actuator 40 operates to eject ink from the pressure chamber 64 through the nozzle 65.

Furthermore, when ink flows back from the pressure chamber 64, pressure waves are transmitted from the pressure chamber 64 to neighboring pressure chambers 64 through the manifold 62. This phenomenon is referred to as a cross talk. The cross talk causes unstable meniscuses of ink in the nozzles 65 of the neighboring pressure chambers 64, and thus, the speed and volume of ink droplets ejected through the nozzles 65 are deviated. In addition, less ink is ejected through the nozzles 65 due to a back flow of ink.

Therefore, the restrictors 63 should have a structure to prevent a back flow of ink, as well as providing an ink path allowing inflow of ink from the manifold 62 to the pressure chambers 64. In other words, a back flow of ink can be easily prevented when the restrictors 63 have a small cross section. However, in this case, ink may be insufficiently filled into the pressure chambers 64 through the restrictors 63. In the conventional piezoelectric inkjet head, the restrictors 63 have a fixed structure (that is, the cross sectional area of the restrictors 63 is fixed), and thus, it is difficult to satisfy these requirements using the restrictors 63.

SUMMARY OF THE INVENTION

The present general inventive concept provides a restrictor formed with a plurality of protrusions to have a high flow resistance in one direction to prevent a back flow of ink without affecting ink refill, and a piezoelectric inkjet head including the restrictor.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a restrictor to connect a pressure chamber and a manifold in an inkjet head, the restrictor including a plurality of protrusions formed on an inner surface of the restrictor in a structure suitable to increase a flow resistance of the restrictor when ink flows from the pressure chamber to the manifold through the restrictor.

The protrusions may extend inward from at least one of both sides of the restrictor and be arranged at predetermined intervals in a length direction of the restrictor.

Each of the protrusions may include: a first surface facing a flow of ink moving through the restrictor in a direction from the manifold to the pressure chamber; and a second surface facing a flow of ink moving through the restrictor in a direction from the pressure chamber to the manifold.

The first surface may be inclined at an angle of 110° to 160° from a side surface of the restrictor, and the second surface may make an angle of 90° or less with the side surface of the restrictor.

Each of the protrusions may have a triangular shape, and a rod-like shape with a predetermined thickness.

The first surface may be curved, and a straight line drawn from a start point to an endpoint of the first surface may make an angle of 110° to 160° with a side surface of the restrictor.

The second surface may be curved, and a straight line drawn from a start point to an endpoint of the second surface may make an angle of 90° or less with the side surface of the restrictor.

The foregoing and/or other aspects and utilities of the present general inventive concept are also achieved by providing a piezoelectric inkjet head including an ink channel formed in a channel plate, the ink channel including an ink inlet, a plurality of pressure chambers, a manifold connected to the ink inlet, a plurality of restrictors respectively connecting the pressure chambers to the manifold, and a plurality of nozzles connected to the pressure chambers, and piezoelectric actuators formed on the channel plate at positions respectively corresponding to the pressure chambers, wherein each of the restrictors includes a plurality of protrusions formed on an inner surface thereof in a structure suitable to increase a flow resistance of the restrictor when ink flows from the pressure chamber to the manifold through the restrictor.

The channel plate may include a plurality of stacked substrates. The channel plate may include an upper substrate in which the pressure chambers and the ink inlet are formed, a middle substrate in which the restrictors and the manifold are formed, and a lower substrate in which the nozzles are formed, wherein the restrictors are formed in a top surface of the middle substrate to a predetermined depth, and the protrusions extend inward from at least one of both sides of each of the restrictors and are arranged at predetermined intervals in a length direction of the restrictor.

The foregoing and/or other aspects and utilities of the present general inventive concept can also be achieved by providing a piezoelectric inkjet head having a pressure chamber and a manifold, the inkjet head including a path connecting the pressure chamber and the manifold, and a plurality of triangles subsequently formed along an inner surface of the path to increase a flow resistance of the path when ink flows from the pressure chamber to the manifold through the path.

Sides of the triangles can merge toward each other in a direction pointing from the manifold to the pressure chamber.

The foregoing and/or other aspects and utilities of the present general inventive concept can also be achieved by providing a piezoelectric inkjet head, including a pressure chamber, a manifold, and a path connecting the pressure chamber and the manifold, the path including opposing sides formed in a sawtooth shape to increase a flow resistance of the path when ink flows from the pressure chamber to the manifold through the path.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
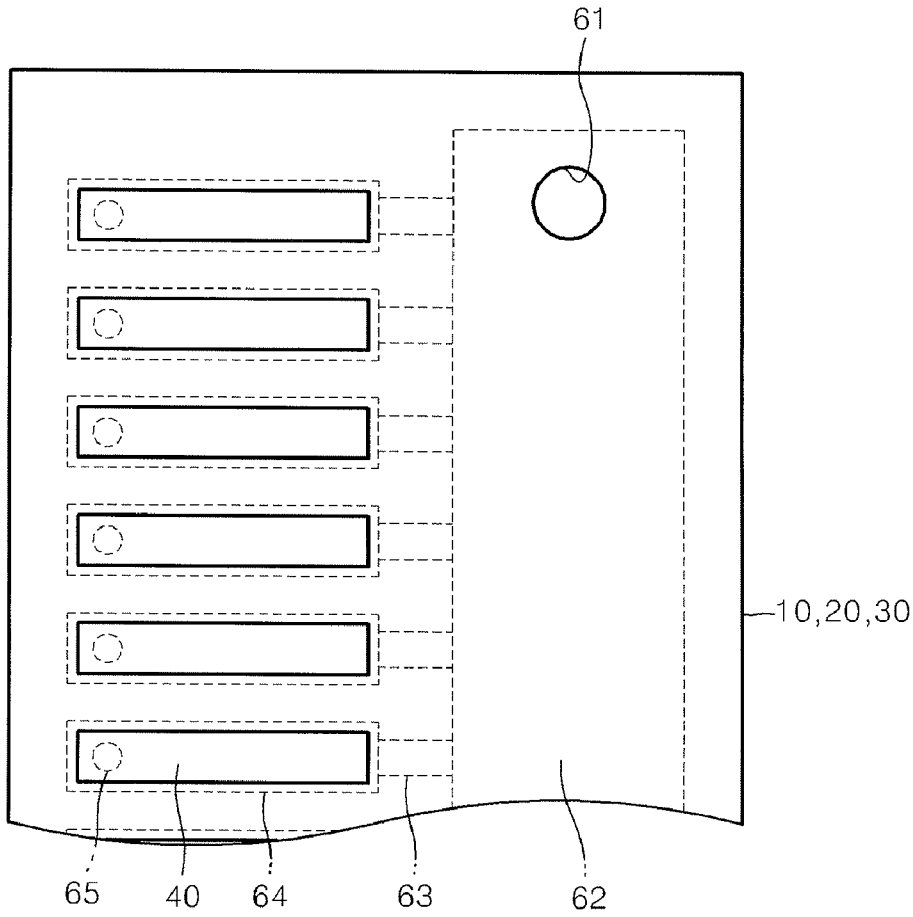
FIG. 1 (PRIOR ART)
FIG. 1 is a plan view illustrating a general structure of a conventional piezoelectric inkjet printhead.
Figure 2:
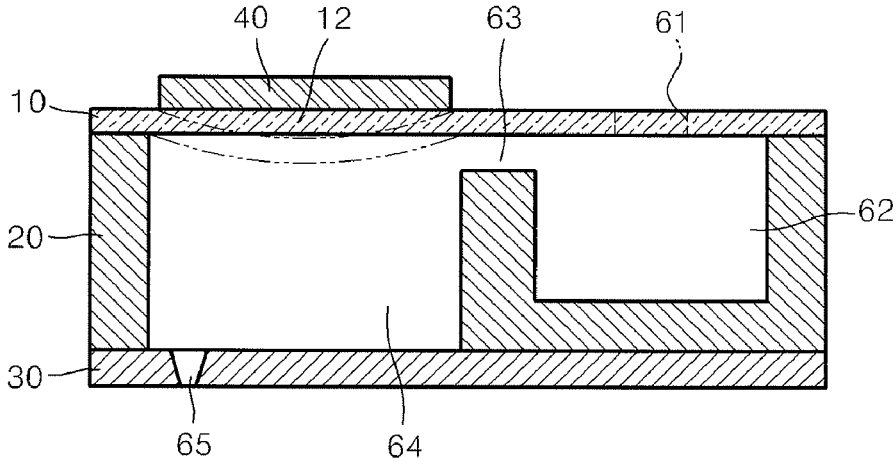
FIG. 2 (PRIOR ART)
FIG. 2 is a cross-sectional view of the piezoelectric inkjet head of FIG. 1, taken in a length direction of a pressure chamber of the inkjet head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
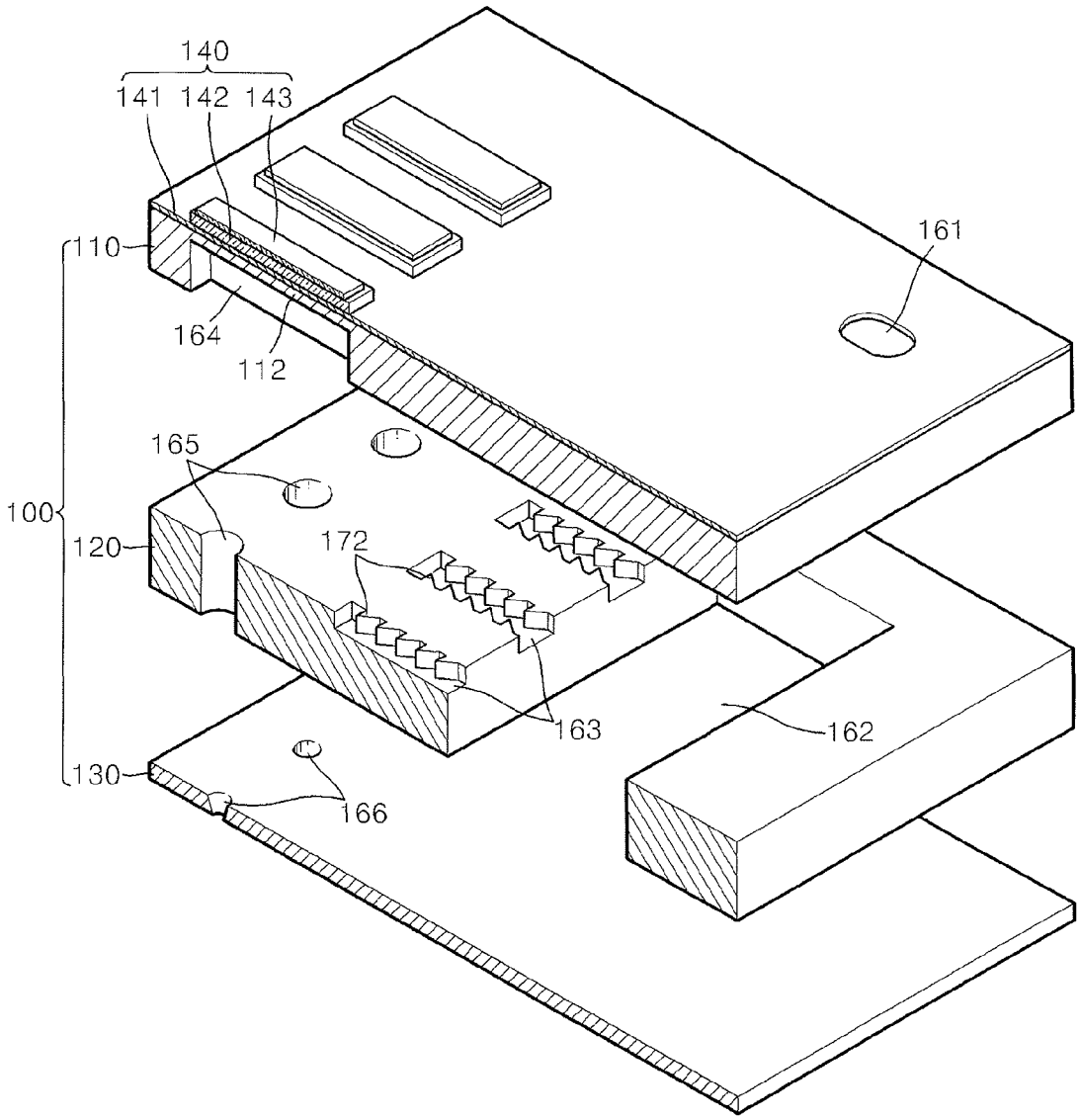
FIG. 3 is an exploded cut-away view illustrating a piezoelectric inkjet head including restrictors formed with protrusions to prevent a back flow of ink according to an embodiment of the present general inventive concept.
Figure 4:
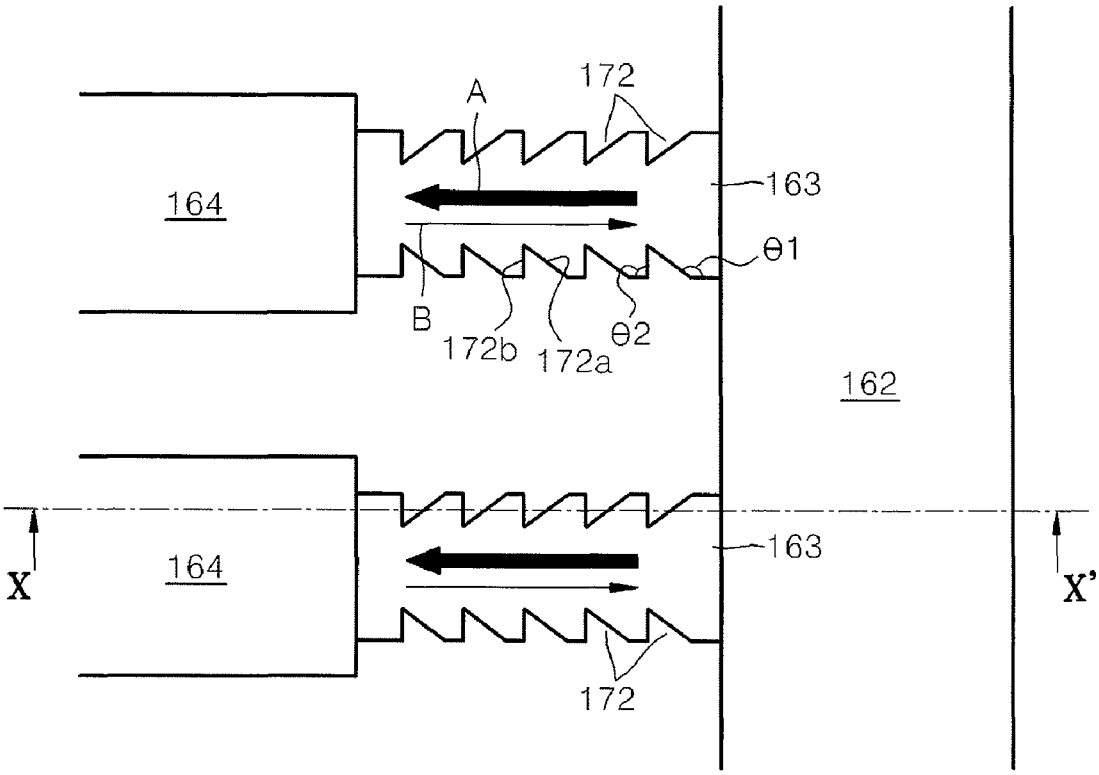
FIG. 4 is an enlarged plan view illustrating the restrictors formed with the protrusions depicted in FIG. 3, according to an embodiment of the present general inventive concept.

FIG. 3 is an exploded cut-away view illustrating a piezoelectric inkjet printhead including restrictors formed with protrusions to prevent a back flow of ink according to an embodiment of the present general inventive concept, and FIG. 4 is an enlarged plan view illustrating the restrictors formed with the protrusions depicted in FIG. 3, according to an embodiment of the present general inventive concept.

Referring to FIG. 3, the piezoelectric inkjet head of the current embodiment includes an ink channel formed in a channel plate 100, and piezoelectric actuators 140 formed on the channel plate 100.

The ink channel includes: an ink inlet 161 through which ink is introduced into the ink channel from an ink tank (not illustrated); a plurality of pressure chambers 164 in which ink is filled to provide ejection of the ink; a manifold 162 along which ink introduced through the ink inlet 161 is supplied to the pressure chambers 164; restrictors 163 connecting the manifold 162 to the pressure chambers 164; and a plurality of nozzles 166 through which ink is ejected from the pressure chambers 164. The ink channel may further include a plurality of dampers 165 respectively connecting the pressure chambers 164 to the nozzles 166.

The ink channel is formed in the channel plate 100. The channel plate 100 may include an upper substrate 110, a middle substrate 120, and a lower substrate 130. The three substrates 110, 120, and 130 may be silicon substrates that are widely used for semiconductor integrated circuits.

In detail, the pressure chambers 164 are formed in a bottom surface of the upper substrate 110 to a predetermined depth, and the ink inlet 161 is formed through the upper substrate 110. The manifold 162 is formed in the middle substrate 120 and has an elongated shape. The manifold 162 is connected to the ink inlet 161. The restrictors 163 are formed in a top surface of the middle substrate 120 to a predetermined depth to connect the manifold 162 to the respective chambers 164. The nozzles 166 are formed in the lower substrate 130 respectively corresponding to the pressure chambers 164. The dampers 165 are formed vertically through the middle substrate 120 to respectively connect the pressure chambers 164 to the nozzles 166.

The channel plate 100 can include two or more substrates. That is, although the channel plate 100 includes the three substrates in the embodiment of FIG. 3, the present general inventive concept is not limited thereto. In addition, the ink channel formed in the channel plate 100 can have a different structure and arrangement.

The piezoelectric actuators 140 apply driving forces to the pressure chambers 164, respectively, to eject ink from the pressure chambers 164. For this, the piezoelectric actuators 140 are formed on the channel plate 100 respectively corresponding to the pressure chambers 164. In detail, the piezoelectric actuators 140 can be formed on a top surface of the channel plate 100 above the pressure chambers 164. In this case, portions of the upper substrate 110 forming top walls of the pressure chambers 164 can be referred to as vibration plates 112 since the vibration plates 112 are periodically deformed by the piezoelectric actuators 140.

Each of the piezoelectric actuators 140 may include a lower electrode 141 as a common electrode, a piezoelectric layer 142 capable of deforming in response to a driving voltage, an upper electrode 143 as a driving electrode. The lower electrode 141 can be formed on the entire top surface of the upper substrate 110 using a conductive metal. The piezoelectric layer 142 is formed on the lower electrode 141 using a piezoelectric material such as a lead zirconate titanate (PZT) ceramic material. The upper electrode 143 is formed on the piezoelectric layer 142 as a driving electrode to apply a driving signal to the piezoelectric layer 142.

The present general inventive concept is characterized in that a plurality of protrusions 172 are formed inside the restrictors 163 to increase flow resistance of the restrictors 163 in one direction. In detail, each of the protrusions 172 are shaped such that the flow resistance of the restrictor 163 is relatively high when ink flows reversely from the pressure chamber 164 to the manifold 164. The protrusions 172 extend inward from both sides of the restrictor 163 and are arranged at predetermined intervals in a length direction of the restrictor 163. Alternatively, the protrusions 172 can be formed only on one side of the restrictor 163.

Referring to FIG. 4, each of the protrusions 172 can have a triangular shape. The protrusion 172 includes a first surface 172*a* and a second surface 172*b*. The first surface 172*a* faces a flow of ink when the ink flows in the direction of arrow A from the manifold 162 to the pressure chamber 164, and the second surface 172*b* faces a flow of ink when the ink flows in the direction of arrow B (a back flow direction) from the pressure chamber 164 to the manifold 162. The first surface 172*a* is inclined not to hinder a flow of ink from the manifold 162 to the pressure chamber 164. An angle $\theta_1$ between the first surface 172*a* and a side surface of the restrictor 163 may be in the range from 110° to 160°. For example, the angle $\theta_1$ can be in the range from 130° to 140°. The second surface 172*b* of the protrusion 172 is approximately perpendicular to the side surface of the restrictor 163 to hinder a back flow of ink. That is, an angle $\theta_2$ between the second surface 172*b* and the side surface of the restrictor 163 can be equal to or less than 90°. For example, the angle $\theta_2$ may be in the range from 60° to 90°.

Since the triangular protrusions 172 are formed inside the restrictor 163, the flow resistance of the restrictor 172 is much larger when ink flows through the restrictor 163 in the direction of arrow B from the pressure chamber 164 to the manifold 162 as compared with when ink flows through the restrictor 163 in the direction of arrow A from the manifold 162 to the pressure chamber 164. Therefore, ink can be smoothly supplied to the pressure chamber 164 through the restrictor 163, and a back flow of ink can be effectively prevented by the restrictor 163.

An operation of the piezoelectric inkjet printhead illustrated in FIGS. 3 and 4 will now be described with reference to FIGS. 4, 5A, and 5B.

Figure 5A:
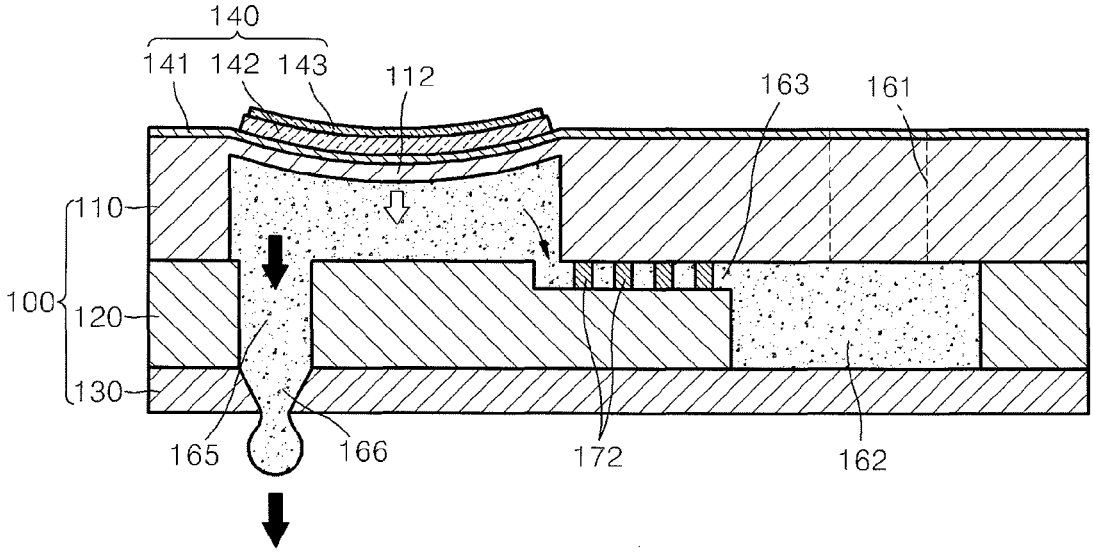
FIGS. 5A and 5B are vertical cross-sectional views taken along line X-X' of FIG. 4 explaining an operation of the piezoelectric inkjet head depicted in FIGS. 3 and 4, according to an embodiment of the present general inventive concept.

Referring to FIGS. 4 and 5A, when a driving signal is applied to the piezoelectric actuator 140, the piezoelectric actuator 140 deforms to bent down the vibration plate 112, thereby reducing the volume of the pressure chamber 164. As a result, the pressure in the pressure chamber 164 increases, and ink is ejected from the pressure chamber 164 through the respective damper 165 and the respective nozzle 166. At this time, the ink can flow back from the pressure chamber 164 to the manifold 162 through the restrictor 163. However, this back flow of the ink is restricted by the protrusions 172 formed on the restrictor 163. In addition, transmission of pressure waves occurring with the back flow can be prevented, and thus, a crosstalk between neighboring nozzles 166 can be prevented. In other words, the separate restrictors 163 prevent the back flow of ink from mixing between the pressure chambers 164.

Figure 5B:
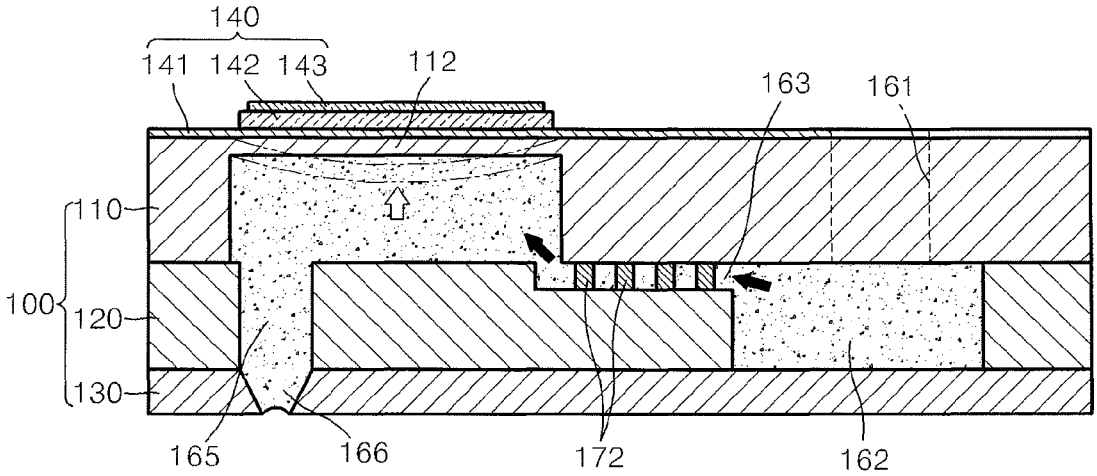

Referring to FIGS. 4 and 5B, when the piezoelectric actuator 140 and the vibration plate 112 return to their original shape after ink is ejected from the pressure chamber 164, the volume of the pressure chamber 164 increases to its original level. As a result, the pressure in the pressure chamber 164 decreases, and thus, ink flows from the manifold 162 to the pressure chamber 164 to refill the pressure chamber 164. Here, since the ink flows in the direction of arrow A, the ink receives a relatively small flow resistance from the restrictor 163 as described above. Therefore, ink can be smoothly supplied to the pressure chamber 164 through the restrictor 163.

Particularly, when the piezoelectric inkjet head operates at a high frequency, the pressure chamber 164 should be rapidly refilled with ink. Accordingly, the restrictor 163 can be formed to have a relatively large sectional area. Then, the ink chamber 164 can be rapidly refilled. However, a back flow of ink from the ink chamber 164 can be effectively prevented as a result of the design of the protrusions 172 although the sectional area of the restrictor 163 is increased.

Modification versions of the protrusions 172 depicted in FIGS. 3 and 4 will now be described with reference to FIGS. 6 and 7 according to embodiments of the present general inventive concept. Protrusions 174 and 176 illustrated in FIGS. 6 and 7 have the same purpose and effect as the protrusions 172 illustrated in FIGS. 3 and 4. Thus, descriptions of the purpose and effect of the protrusions 174 and 176 will be omitted.

Figure 6:
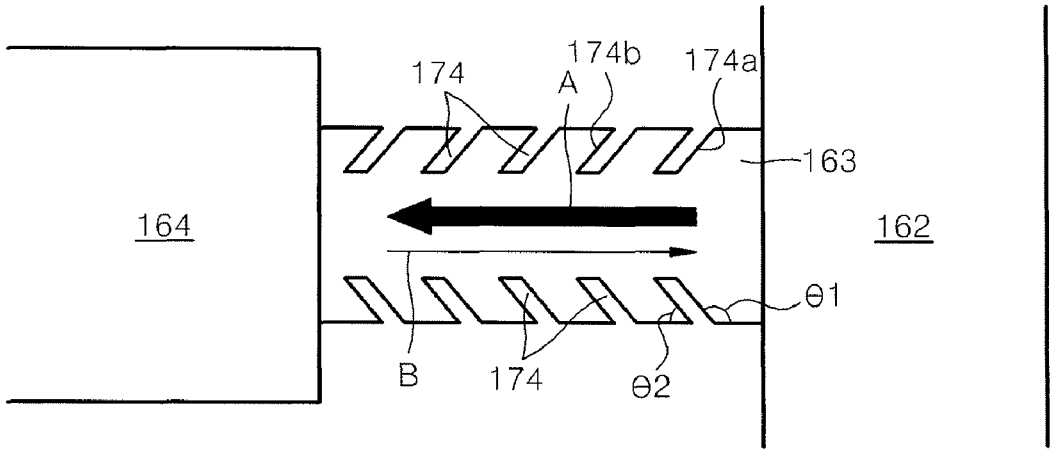
FIGS. 6 and 7 are plan views illustrating modification versions of the protrusions depicted in FIGS. 3 and 4, according to embodiments of the present general inventive concept.

Referring to FIG. 6, the protrusions 174 are formed inside the restrictor 163 between the manifold 162 and the pressure chamber 164 to increase the flow resistance of the restrictor 163 when ink flows in the direction of arrow B from the pressure chamber 164 to the manifold 162. The protrusions 174 extend inward from one or both sides of the restrictor 163 and are arranged at predetermined intervals in a length direction of the restrictor 163. Each of the protrusions 174 has a predetermined thickness and is shaped like a rod. Each of the protrusions 174 includes a first surface 174*a* and a second surface 174*b*. The first surface 174*a* faces a flow of ink when the ink flows in the direction of arrow A from the manifold 162 to the pressure chamber 164, and the second surface 174*b* faces a flow of ink when the ink flows in the direction of arrow B (a back flow direction) from the pressure chamber 164 to the manifold 162. The first surface 174*a* is inclined so as not to hinder a flow of ink from the manifold 162 to the pressure chamber 164. An angle $\theta_1$ between the first surface 174*a* and a side surface of the restrictor 163 may be in the range from 110° to 160°. For example, the angle $\theta_1$ can be in the range from 130° to 140°. The second surface 174*b* of the protrusion 174 is parallel to the first surface 174*a*. Thus, an angle $\theta_2$ between the second surface 174*b* and the side surface of the restrictor 163 is acute and is determined by the angle $\theta_1$. Therefore, a back flow of ink is hindered by the second surface 174*b*.

Figure 7:
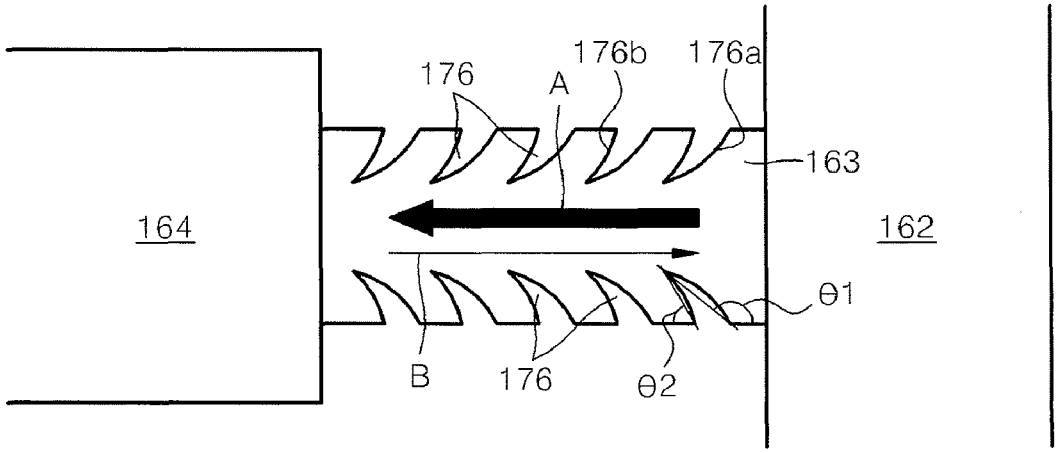

Referring to FIG. 7, each of the protrusions 176 formed inside the restrictor 163 includes a first surface 176*a* and a second surface 176*b*. The first surface 176*a* faces a flow of ink when the ink flows in the direction of arrow A from the manifold 162 to the pressure chamber 164, and the second surface 176*b* faces a flow of ink when the ink flows in the direction of arrow B (a back flow direction) from the pressure chamber 164 to the manifold 162. The first surface 172*a* is curved so as not to hinder a flow of ink from the manifold 162 to the pressure chamber 164. In this case, the flow resistance of the restrictor 163 can be significantly reduced when ink flows through the restrictor 163 in the direction of arrow A. A straight line drawn from a start point to an endpoint of the first surface 176*a* makes an angle $\theta_1$ with a side surface of the restrictor 163, and the angle $\theta_1$ may be in the range from 110° to 160°. For example, the angle $\theta_1$ can be in the range from 130° to 140°. The second surface 176*b* can be curved, and a straight line drawn from a start point to an endpoint of the second surface 176*b* can make an angle $\theta_2$ of 90° or less with the side surface of the restrictor 163 to hinder a back flow of ink from the pressure chamber 164 to the manifold 162. For example, the angle $\theta_2$ may be in the range from 40° to 80°. Alternatively, the second surface 176*b* of the protrusion 176 can be straight. In this case, the second surface 176*b* may be perpendicular to or inclined toward the side surface of the restrictor 163.

When the protrusions 174 or 176 are formed inside the restrictor 163 as illustrated in FIG. 6 or 7, the flow resistance of the restrictor 163 is much larger when ink flows through the restrictor 163 in the direction of arrow B from the pressure chamber 164 to the manifold 162 as compared with when ink flows through the restrictor 163 in the direction of arrow A from the manifold 162 to the pressure chamber 164. Therefore, ink can be smoothly supplied through the restrictor 163, and a back flow through the restrictor 163 can be effectively prevented.

As described above, according to the piezoelectric inkjet head of the present general inventive concept, the plurality of protrusions are formed inside restrictors formed between a manifold and pressure chambers in order to increase a flow resistance of the restrictors in one direction (a back flow direction). Therefore, ink does not easily flow back from the pressure chambers to the manifold through the restrictors. In addition, transmission of pressure waves occurring with the back flow of ink can be prevented, and thus, a crosstalk between neighboring nozzles can be prevented. Moreover, since the flow resistance of the restrictors is relatively small when ink flows through the restrictors from the manifold to the pressure chambers, the pressure chambers can be smoothly and quickly refilled with ink.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A restrictor to connect a pressure chamber and a manifold in an inkjet head, the restrictor comprising:

a plurality of protrusions formed on an inner surface of the restrictor in a structure suitable to increase a flow resistance of the restrictor when ink flows from the pressure chamber to the manifold through the restrictor.

2. The restrictor of claim 1, wherein the protrusions extend inward from at least one of both sides of the restrictor and are arranged at predetermined intervals in a length direction of the restrictor.

3. The restrictor of claim 1, wherein each of the protrusions comprises:

a first surface facing a flow of ink moving through the restrictor in a direction from the manifold to the pressure chamber; and a second surface facing a flow of ink moving through the restrictor in a direction from the pressure chamber to the manifold.

4. The restrictor of claim 3, wherein the first surface is inclined at an angle of 110° to 160° from a side surface of the restrictor, and the second surface makes an angle of 90° or less with the side surface of the restrictor.

5. The restrictor of claim 4, wherein the first surface is inclined at an angle of 130° to 140° from the side surface of the restrictor.

6. The restrictor of claim 4, wherein each of the protrusions has a triangular shape, and the second surface makes an angle of 60° to 90° with the side surface of the restrictor.

7. The restrictor of claim 4, wherein each of the protrusions has a rod-like shape with a predetermined thickness.

8. The restrictor of claim 3, wherein the first surface is curved, and a straight line drawn from a start point to an endpoint of the first surface makes an angle of 110° to 160° with a side surface of the restrictor.

9. The restrictor of claim 8, wherein the straight line drawn from the start point to the endpoint of the first surface makes an angle of 130° to 140° with the side surface of the restrictor.

10. The restrictor of claim 8, wherein the second surface is curved, and a straight line drawn from a start point to an endpoint of the second surface makes an angle of 90° or less with the side surface of the restrictor.

11. The restrictor of claim 10, wherein the straight line drawn from the start point to the endpoint of the second surface makes an angle of 40° to 80°.

12. A piezoelectric inkjet head comprising:

an ink channel formed in a channel plate, the ink channel including an ink inlet, a plurality of pressure chambers, a manifold connected to the ink inlet, a plurality of restrictors respectively connecting the pressure chambers to the manifold, and a plurality of nozzles connected to the pressure chambers; and piezoelectric actuators formed on the channel plate at positions respectively corresponding to the pressure chambers, wherein each of the restrictors includes a plurality of protrusions formed on an inner surface thereof in a structure to increase a flow resistance of the restrictor when ink flows from the pressure chamber to the manifold through the restrictor.

13. The piezoelectric inkjet head of claim 12, wherein the channel plate comprises a plurality of stacked substrates.

14. The piezoelectric inkjet head of claim 13, wherein the channel plate comprises:

an upper substrate in which the pressure chambers and the ink inlet are formed;

a middle substrate in which the restrictors and the manifold are formed; and a lower substrate in which the nozzles are formed, wherein the restrictors are formed in a top surface of the middle substrate to a predetermined depth, and the protrusions extend inward from at least one of both sides of each of the restrictors and are arranged at predetermined intervals in a length direction of the restrictor.

15. The piezoelectric inkjet head of claim 12, wherein each of the protrusions comprises:

a first surface facing a flow of ink moving through the restrictor in a direction from the manifold to the pressure chamber; and a second surface facing a flow of ink moving through the restrictor in a direction from the pressure chamber to the manifold.

16. The piezoelectric inkjet head of claim 15, wherein the first surface is inclined at an angle of 110° to 160° from a side surface of the restrictor, and the second surface makes an angle of 90° or less with the side surface of the restrictor.

17. The piezoelectric inkjet printhead of claim 16, wherein each of the protrusions has a triangular shape, and the second surface makes an angle of 60° to 90° with the side surface of the restrictor.

18. The piezoelectric inkjet printhead of claim 16, wherein each of the protrusions has a rod-like shape with a predetermined thickness.

19. The piezoelectric inkjet printhead of claim 15, wherein the first and second surfaces are curved, wherein a straight line drawn from a start point to an endpoint of the first surface makes an angle of 110° to 160° with a side surface of the restrictor, and a straight line drawn from a start point to an endpoint of the second surface makes an angle of 90° or less with the side surface of the restrictor.

20. A piezoelectric inkjet head having a pressure chamber and a manifold, the inkjet head comprising:

a path connecting the pressure chamber and the manifold; and a plurality of triangles subsequently formed along an inner surface of the path to increase a flow resistance of the path when ink flows from the pressure chamber to the manifold through the path.

21. The piezoelectric inkjet head of claim 20, wherein sides of the triangles merge toward each other in a direction toward the pressure chamber from the manifold.

22. The piezoelectric inkjet head of claim 21, wherein the sides of the path are formed in a sawtooth structure.

23. A piezoelectric inkjet head, comprising:

a pressure chamber;

a manifold; and a path connecting the pressure chamber and the manifold, the path including opposing sides formed in a sawtooth shape to increase a flow resistance of the path when ink flows from the pressure chamber to the manifold through the path.

* * * * *